US007004336B2

(12) United States Patent
Dagan

(10) Patent No.: US 7,004,336 B2
(45) Date of Patent: Feb. 28, 2006

(54) STORAGE RACK FOR BOTTLES AND JARS

(76) Inventor: Gideon Dagan, 986 Vernon Ave., Venice, CA (US) 90291

( * ) Notice: Subject to any disclaimer, the term of this patent is extended or adjusted under 35 U.S.C. 154(b) by 0 days.

(21) Appl. No.: 10/746,510

(22) Filed: Dec. 23, 2003

(65) Prior Publication Data

US 2005/0011843 A1 Jan. 20, 2005

Related U.S. Application Data

(63) Continuation-in-part of application No. 10/620,519, filed on Jul. 16, 2003, now abandoned.

(51) Int. Cl.
*A47F 7/00* (2006.01)

(52) U.S. Cl. ..... 211/181.1; 211/74; 211/189; 211/194

(58) Field of Classification Search ..... 211/74, 211/75, 601, 194, 71.01, 189, 181.1, 60.1, 211/85.18, 183
See application file for complete search history.

(56) References Cited

U.S. PATENT DOCUMENTS 3,746,178 A * 7/1973 Wagschal ..... 211/74
3,889,834 A * 6/1975 Harris, Jr. ..... 215/10
3,918,920 A * 11/1975 Barber ..... 422/104
4,270,662 A * 6/1981 Gonzalez ..... 211/74
4,746,487 A * 5/1988 Wachter ..... 376/272
5,038,942 A * 8/1991 Wright ..... 211/40
5,375,716 A * 12/1994 Rubin et al. ..... 206/443
5,655,673 A * 8/1997 Weterrings et al. ..... 211/75
5,947,305 A * 9/1999 Lin ..... 211/74
6,053,338 A * 4/2000 Avery et al. ..... 211/65
6,209,735 B1 * 4/2001 Gladstone et al. ..... 211/88.01

OTHER PUBLICATIONS

Kartell Catalog, Infinity Design by Ron Arad.
Kartell Flyer, Model #7680.
MAGIS Catalog, Stackable Bottle Rack.
MAGIS Catalog, 'Bottle' Stackable Wine Rack by Jasper Morrison.
Winerack Store, Versatile Wooden Wine Racks.
Winerack Store, Wine Storage Cubes.
Winerack Store, Metal Wine Racks.
Winerack Store, Premium Wine Racks.
The Beverly Hills Organizer, Stackable Wine Rack.
MoMA Online Store, Objx Wine Rack.

* cited by examiner

*Primary Examiner*—Jennifer E. Novosad
(74) *Attorney, Agent, or Firm*—Seldon & Scillieri

(57) ABSTRACT

A modular rack for storing objects. Each rack element has forward, rear, and side walls. The rack elements are configured to have a plurality of protrusions and recessions so that the protrusions and recessions of a rack element slideably interlock with complementary recessions and protrusions of other rack elements of generally similar appearance, so that the rack elements may be assembled into a modular rack without the need of tools or external fastening elements.

31 Claims, 9 Drawing Sheets

STORAGE RACK FOR BOTTLES AND JARS

CROSS-REFERENCE TO RELATED APPLICATIONS

Applicant claims priority of U.S. Design patent application, Ser. No. 29/182,631, filed May 29, 2003, now issued as U.S. Design No. 488,964, and U.S. patent application, Ser. No. 10/620,519, filed Jul. 16, 2003, now abandoned.

FIELD OF THE INVENTION

This invention relates to supporting racks, and more specifically, to racks which support receptacles for bottles or jars.

BACKGROUND

Numerous types of bottle racks are known in the art for storing diverse items such as bottles of wine, soda, and beer, cans of soda and beer, jars of condiments and other containers for liquids, food products, and the like.

Racks, which are not designed in a modular fashion, suffer from the disadvantage that the maximum number of items which the rack may accommodate is fixed and cannot be increased because the structure is fixed.

Racks which are modular suffer from the disadvantage of requiring that the individual units be fastened together by fasteners and generally require detailed assembly instructions. Such assembly generally requires tools as well as small fastening pieces such as screws and nuts which may be easily lost. Assembly of such modular units requires time and the method of assembly of the units and assembly instructions may be unduly complicated.

SUMMARY OF THE INVENTION

The invention herein is a rack that can be configured in any of numerous ways to maximize the storage of cans, bottles, and jars (hereinafter collectively referred to as "containers").

Briefly, the invention herein is a modular rack comprising a rack element having a plurality of protrusions and recessions that are configured to interlock with complimentary recessions and protrusions of other rack elements of generally similar appearance. Preferably, a rack element has protrusions and/or recessions at the top, bottom, and left and right sides. The rack can be expanded in all directions to fill the desired space and support the desired number of containers. The rack elements may be attached together without the need of separate fasteners or tools.

Additionally, the invention herein is a rack which in certain embodiments provides insulation around container accommodating openings so that a relatively constant container temperature will be maintained and, at the same time, ventillation through the container accommodating openings is also provided to, inter alia, prevent odor.

In a preferred embodiment, the invention is a rack that is structured to provide insulation of container accommodating openings by means of a double wall chamber enclosing an insulating air volume and, at the same time, ventilation through container accommodating openings is also provided to, inter alia, prevent odor.

DESCRIPTION OF PREFERRED EMBODIMENTS

Figure 1A:
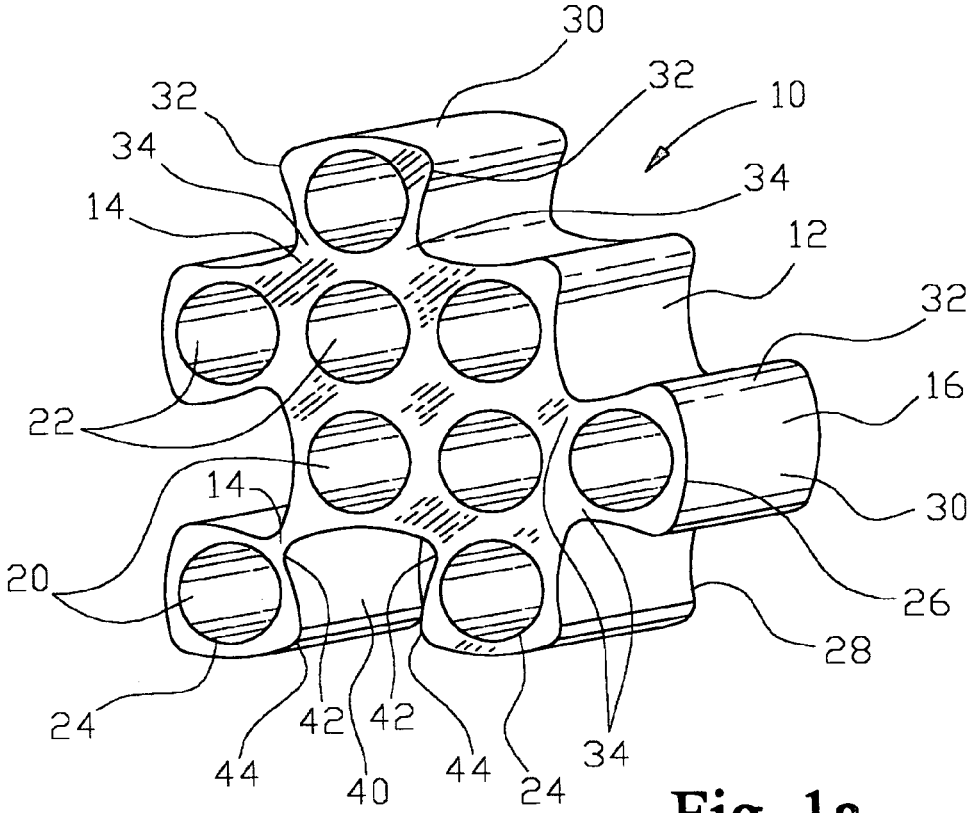
FIG. 1*a* is a perspective view of an element of the new rack.

The present invention will now be described more fully hereinafter with reference to the accompanying drawings, in which preferred embodiments of the invention are shown. The invention, may, however, be embodied in different forms and should not be construed as limited to the embodiments set forth herein; rather, these embodiments are provided so that this disclosure will be thorough and complete, and will fully convey the scope of the invention to those skilled in the art. Like reference numerals refer to like elements throughout.

Figure 1B:
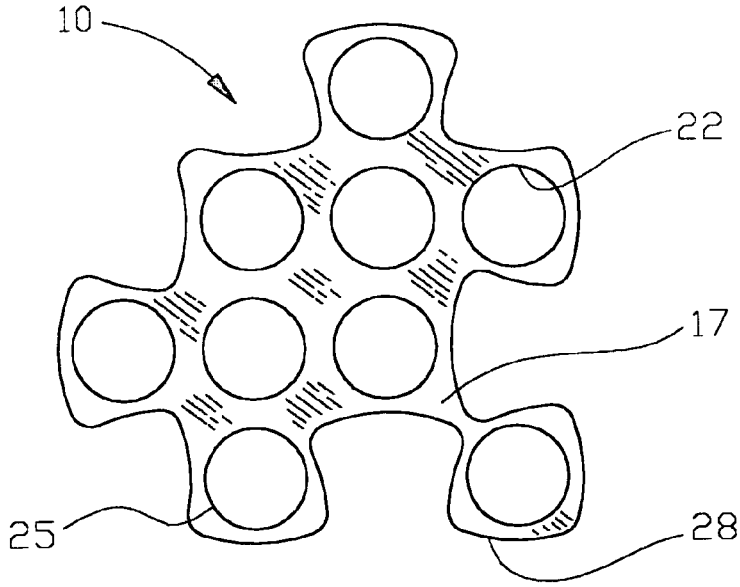
FIG. 1*b* is a rear elevational view of an element of the new rack in the orientation of FIG. 1*a;*
Figure 3:
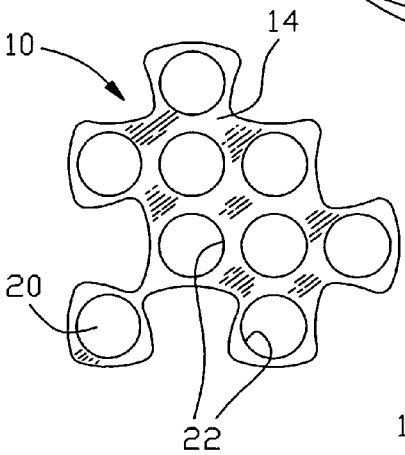
FIG. 3 is a front elevational view of an element of the new rack in the orientation shown in FIG. 1.

Referring initially to FIGS. 1*a*, 1*b*, and 3, there is disclosed therein a rack element 10. The rack element 10 is comprised of a housing 12 having a forward wall 14, a side wall 16, and a rear wall 17. The rear wall 17 is substantially identical to the forward wall 14. The forward wall 14 has a plurality of container accommodating openings 20 defined by interior walls 22. The interior wall 22 of each of the container accommodating openings 20 meet the forward wall 14 at edge 24, and the rear wall 17 at edge 25.

The forward wall 14 of the housing 12 meets the side wall 16 at forward edge 26. Similarly, the side wall 16 meets the rear wall 17 at rearward edge 28.

Each of the interior walls 22 of the container accommodating openings 20 extends from the container forward surface 24 to the rear wall 17. Each of the container accommodating openings has a longitudinal axis and each such axis may, but is not required to be parallel to each of the other axises.

The housing 12 has at least one protrusion portion 30 comprised of a head portion 32 and a neck portion 34. The protrusion portion 30 is formed by a portion of the side, forward and rear walls, 16, 14 and 17, respectively. As will be appreciated, the neck portion 34 of the forward and rear walls is more narrow than the head portion 32 of the forward and rear walls.

A portion of the side wall 16, forward wall 14, and rear wall 17 of the housing 12 also defines at least one recession portion 40 defining a head accommodating portion 42 and a neck retaining portion 44.

The shape of the recession portion 40 is substantially similar to the shape of the protrusion portion 30. However, the size of the recession portion 40 is slightly smaller than the size of the protrusion portion 30. As will be discussed in further detail below, this structure allows slidable interengagement of the protrusion portion and recession portion of the rack elements in the manner described below.

Figure 2:
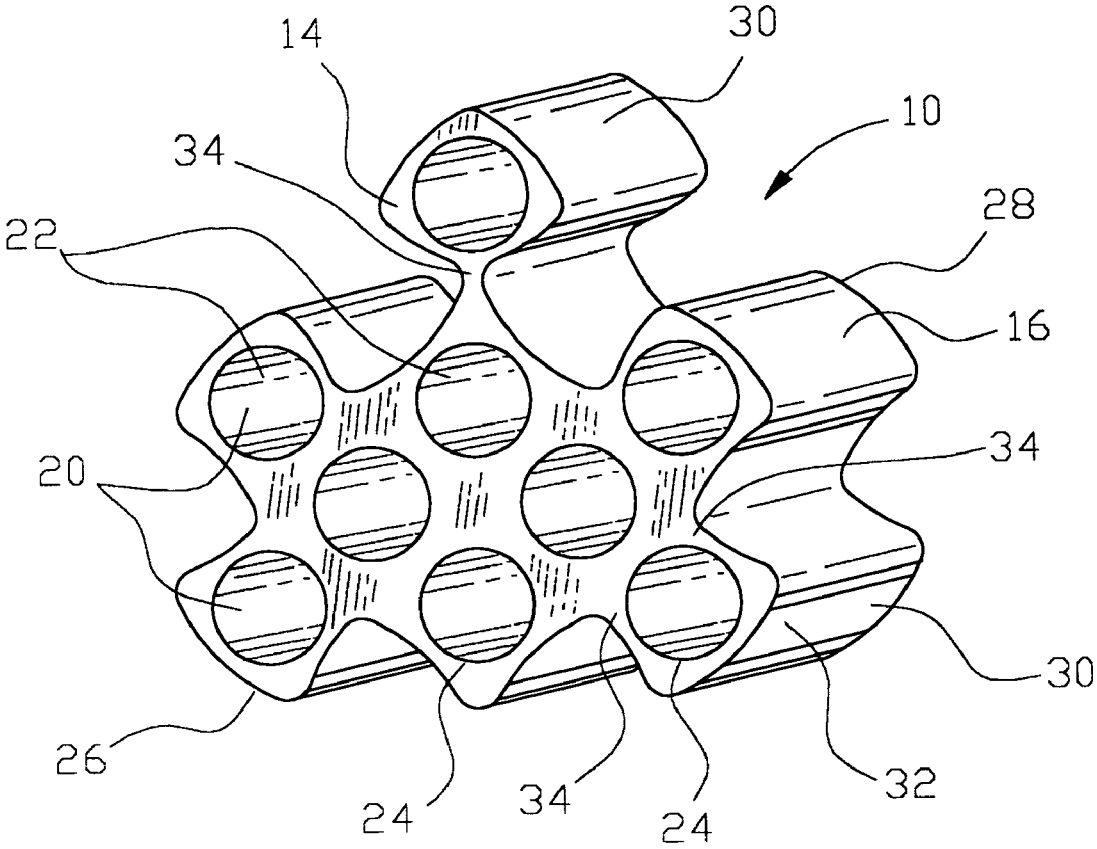
FIG. 2 is a perspective view of the rack element of FIG. 1 rotated approximately 135° in a clockwise direction.

Next referring to FIG. 2, there is disclosed therein the rack element 10 of the present invention rotated approximately 135° clockwise from the position of FIG. 1*a*. As will be disclosed in greater detail hereinbelow, the rack elements may be slidably interengaged in various orientations.

Figure 4:
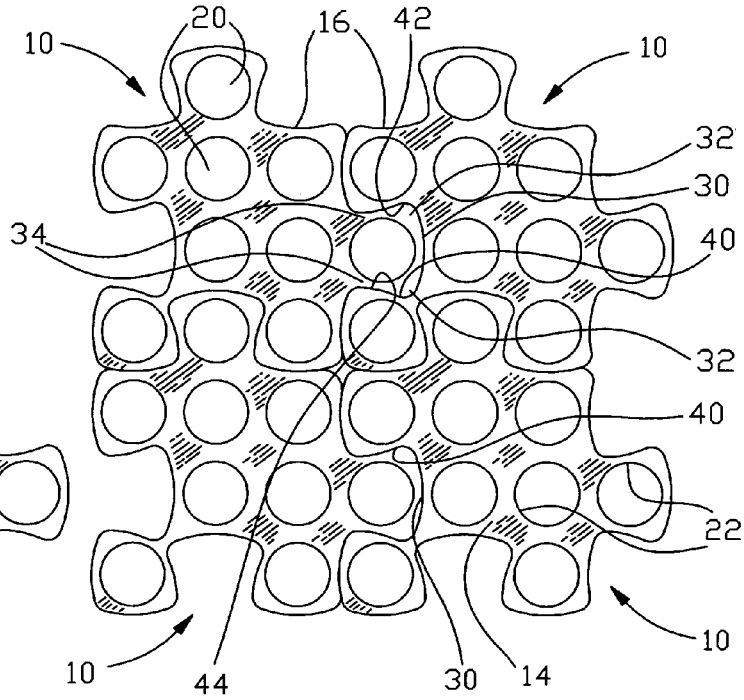
FIG. 4 is a front elevational view of a first arrangement of a plurality of elements of the new rack in the orientation of FIG. 1 interconnected.

Next referring to FIG. 4, there is disclosed therein a plurality of rack elements 10 in the orientation of FIGS. 1*a* and 3, wherein the rack elements 10 have been slidably engaged so that the protrusion portion 30 is slidably engaged with the recession portion 40 of the adjacent rack element. In such a configuration, the head portion 32 and neck portion 34 of a first rack element are slidably interengaged and are received by the head accommodating portion 42 and neck accommodating portion 44 of a second rack element. In such a configuration, the side wall surface 16 of the protrusion portion 30 abuts the side wall surface 16 of the recession portion 40.

As will be appreciated, the interengagement of the protrusion portion and recession portion is accomplished by sliding the protrusion portion into the recession portion. In such a configuration, the neck retention portion will prevent the protrusion portion of the adjacent rack element from separating from the adjacent rack element, except in a direction perpendicular to the forward surface 14 of the housing 12, that is, the protrusion portion 30 and recession portion 40 are slidably interengaged in a direction parallel to the side wall 16.

This interengagement produces a highly stable modular rack which is capable of expansion without the need for rearranging rack elements which have already become part of the modular rack. The modular rack is strong, easy to assemble, and the addition of additional rack elements is quick, easy and does not require the use of external fasteners or tools. Assembling the rack elements also does not require detailed instructions which might be lost or misplaced.

Figure 5:
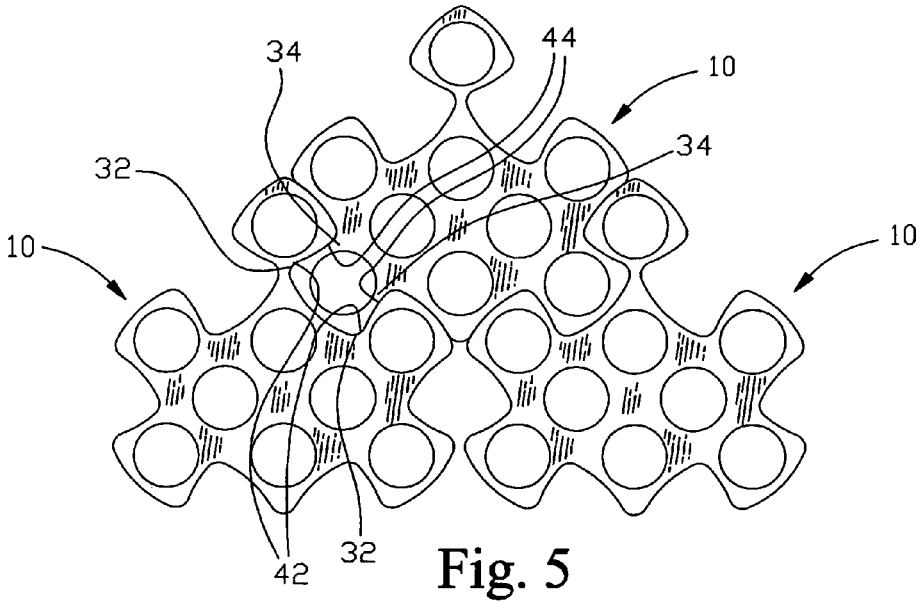
FIG. 5 is a front elevational view of a second arrangement of a plurality of elements of the new rack in the orientation of FIG. 2.

Next referring to FIG. 5, there is shown a modular assembly of rack elements 10 in the orientation of FIG. 2. As will be appreciated, the rack elements in this orientation are similarly engaged with adjacent elements in the manner and pursuant to the structure set forth above. Such an arrangement is stable and allows expansion with ease and without the need for external fasteners or the like. It is advantageous to use this particular orientation of the modular rack adjacent or in areas such as next to staircases and the like which benefit from having the modular rack form an arrangement having a triangular or diagonal configuration.

Figure 6:
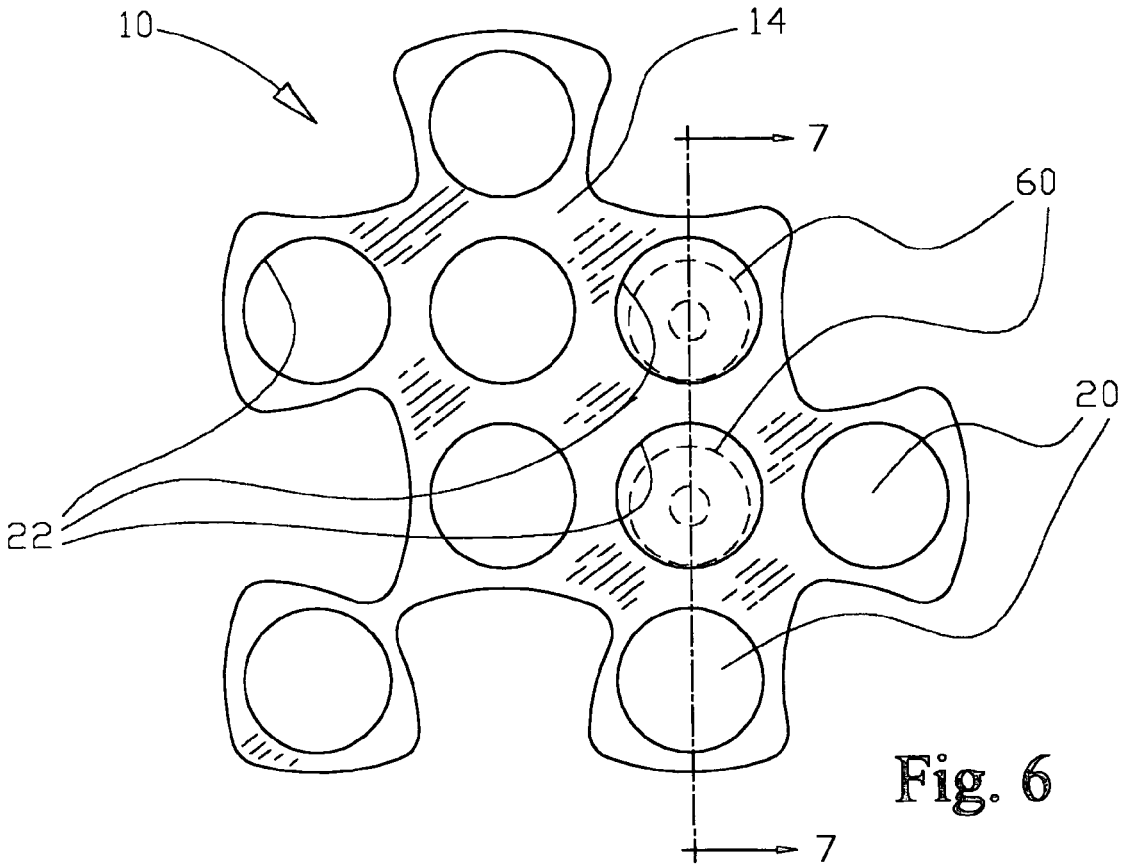
FIG. 6 is a front elevational view of an element of the new rack in receipt of two bottles.
Figure 7:
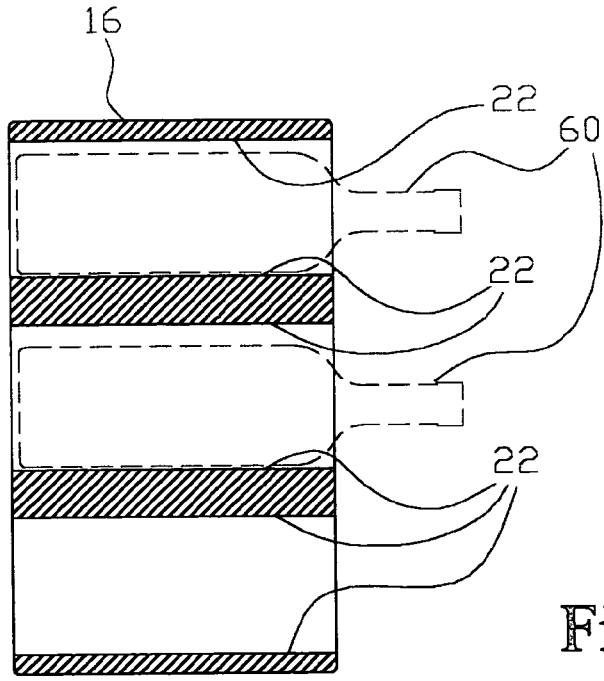
FIG. 7 is a cross-sectional view taken along line 7—7 of FIG. 6.

Next referring to FIGS. 6 and 7, there is disclosed therein a rack element 10 in which bottles 60 (shown by dashed lines) have been placed for storage. As will be appreciated by those having ordinary skill in the art, storage of bottles with their longitudinal axises parallel to the ground is in many instances highly advantageous. For example, with respect to the storage of wine bottles, it is preferred to store such bottles in such an alignment so that the liquid in the bottle is in contact with the cork stopper. In this configuration, the liquid will tend to keep the cork stopper (not shown) moist and, consequently, the seal provided by the cork stopper will more likely be maintained.

The rack elements may be manufactured of wood, metal, plastic, foam or other similar materials. When the rack is manufactured of plastic or similar materials, the rack may be manufactured by processes such as by injection, blow or rotational molding, or formed by a casting process, which manufacturing processes are well known to those having ordinary skill in the art.

The container accommodating openings 20 are shown in the drawings as cylinders having circular cross sections. However, container accommodating openings of elliptical, triangular, square, rectangular, pentagonal, etc., cross-section are also possible and within the scope of the invention.

Figure 8:
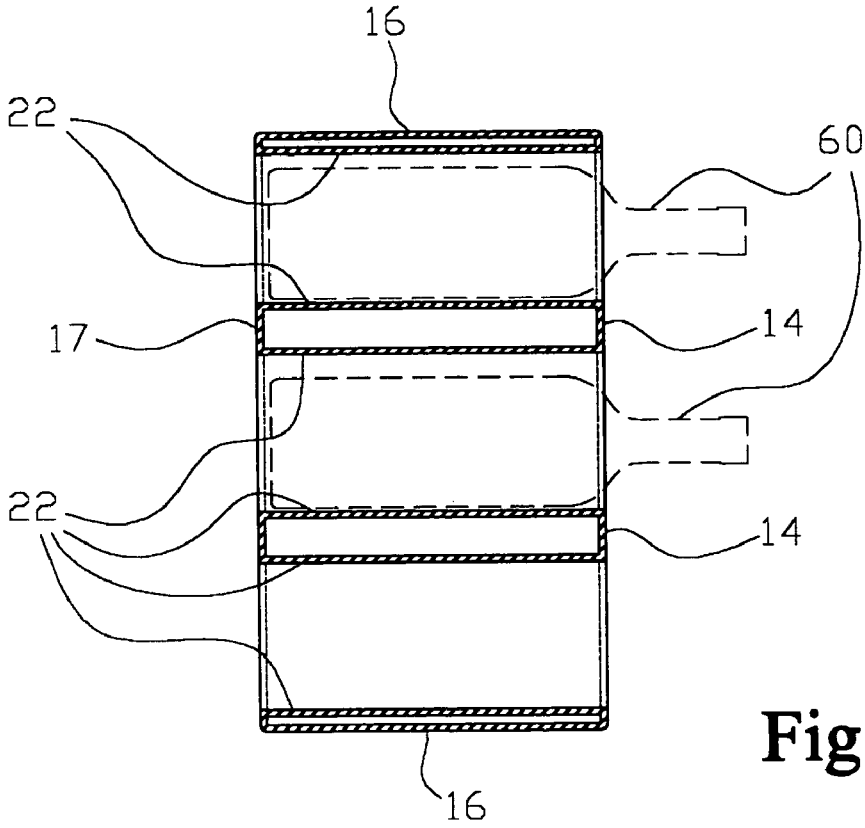
FIG. 8 is a cross-sectional view of a second embodiment of my invention taken along line 7—7 of FIG. 6.

Next referring to FIG. 8, there is disclosed therein another preferred embodiment of the rack element. In this construction, the rack element is hollow and the orientation between the forward wall 14 and the rear wall 17 is maintained by the side wall 16 and the container interior walls 22. The remainder of the interior of the housing 12 contains air. Such a structure is extremely light, but is rigid and capable of supporting containers. Also, the air within the rack element acts as an insulator. Such a construction also enables the rack element to provide thermal insulation of containers within the container interior walls 22 while at the same time providing ventilation for the containers. This is of importance for certain containers such as wine bottles, which should be stored horizontally, protected from temperature fluctuation and light induced damage while at the same time providing adequate ventilation.

Figure 9:
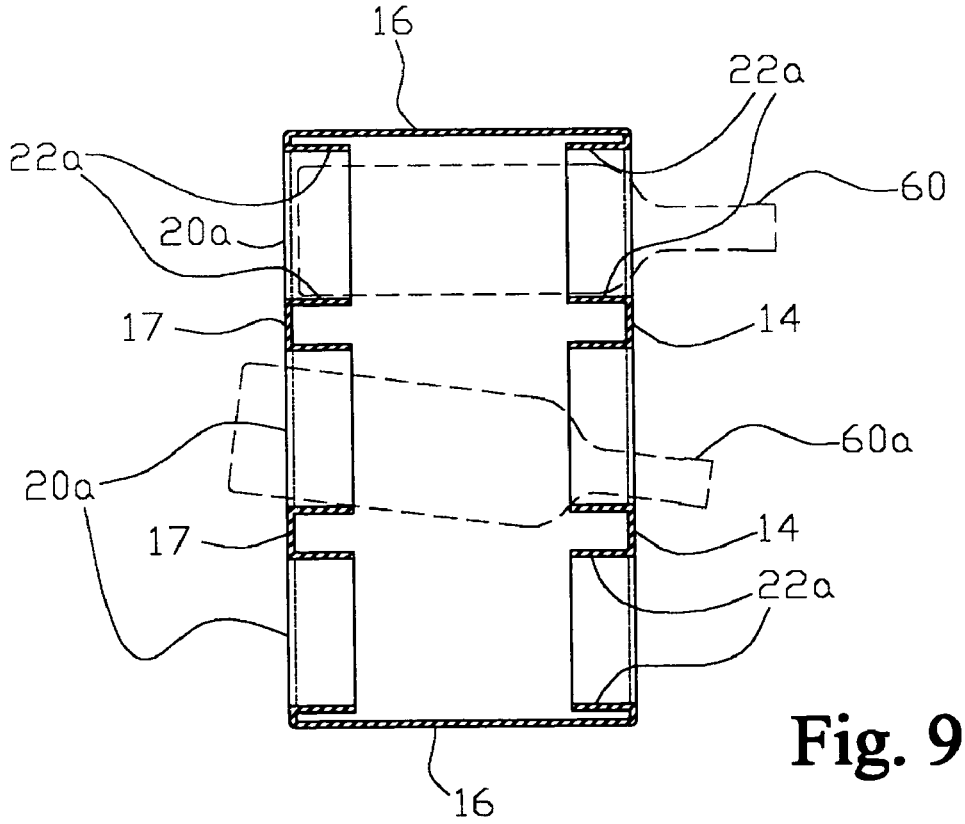
FIG. 9 is a cross-sectional view of a third embodiment of my invention taken along line 7—7 of FIG. 6.

Next referring to FIG. 9, there is disclosed therein another preferred embodiment of the rack element, wherein the orientation of the forward wall 14 and the rear wall 17 is maintained solely by the side wall 16. In this embodiment, a container accommodating flanges 20*a* extend inwardly defining openings 20*a* in the forward wall 14 and rear wall 17. In this embodiment, containers may be stored so that the longitudinal axis of the bottles are parallel to the ground as with container 60 or, alternatively, containers may be positioned so that the respective longitudinal axises will form an acute angle with the horizontal, such as illustrated with container 60*a* in FIG. 9. In certain situations, this is highly desirable if the liquid level in the container is low and it is necessary for the liquid to cover the stopper such as to prevent the stopper from drying out.

The embodiment of FIG. 9 is also desirable because it is light, and inexpensive to manufacturer. It may also be formed of a plastic by rotational molding or blow molding which are manufacturing techniques well known to those having ordinary skill in the art.

Figure 10:
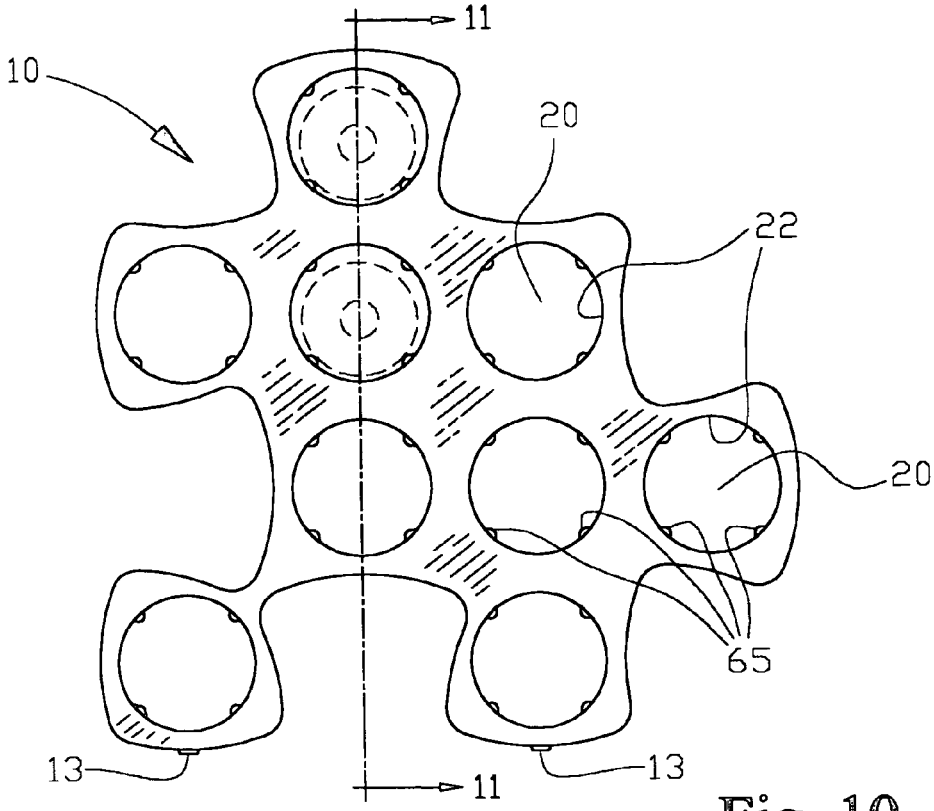
FIG. 10 is a front elevational view of another embodiment of my invention.
Figure 11:
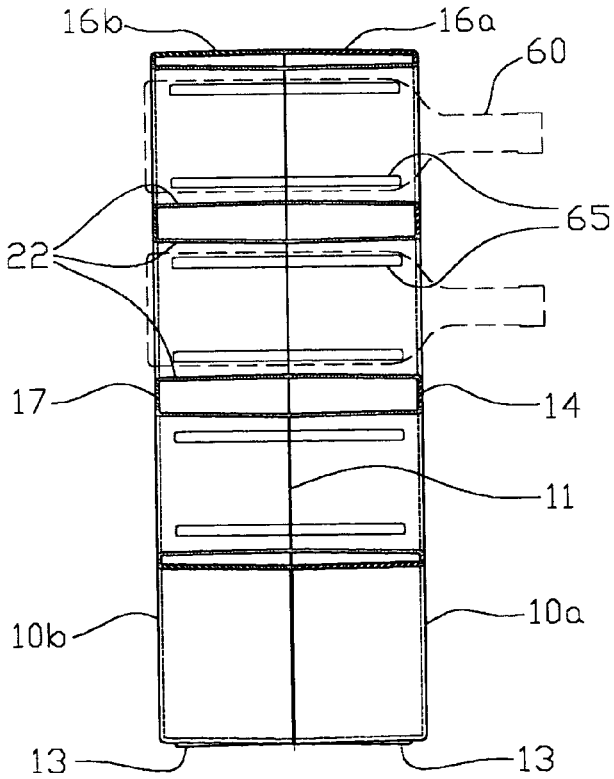
FIG. 11 is a cross-sectional view of another embodiment of my invention taken long line 11—11 of FIG. 10.

Next referring to FIGS. 10 and 11, there is shown therein yet another alternative preferred embodiment of the invention which is preferably made by an injection molding process, and wherein the rack element 11 comprises forward and rear element halves 10*a* and 10*b* which meet at seam 11. The interior surfaces 22 of the container accommodating openings 20 have a plurality of ribs 65 extending longitudinally along the interior surface of the container accommodating interior walls 22. Near the seam 11 of the forward element half 16*a*, the ribs 65 are of slightly lower height than near the forward surface 14. Similarly, near the seam 11 of the rear element half 16*b*, the ribs 65 are of slightly lower height than the portion of the ribs 65 near the rear surface 17. This slight asymmetry is preferable due to asymmetry of the rack element. Such asymmetry may be due to the necessity to provide a draft in each of the forward and rear element halves 10*a* and 10*b* in order to easily remove each half from the mold, i.e., the interior angles between the forward wall 14 and the interior walls 22 of the container accommodating openings 20 and the interior angles between rear wall 17 and the interior walls 22 of the container accommodating openings 20 may be slightly greater than 90 degrees to enable the rack elements to be easily removed from the mold. In a preferred embodiment, these interior angles are 91°. The ribs are structured to compensate for this and to position the containers horizontal to the ground so that environmental vibration will not tend to cause the containers to travel or slip out of the container accommodating openings.

In such a structure, the containers will also be more securely retained in that they will not be subject to rolling within the container accommodating interior walls 22 or slipping out. For example, if the surface on which the rack is positioned is subject to vibration, the container will be less likely to rock within the container accommodating interior walls. As will be appreciated to those with ordinary skill in the art, if the container accommodating walls 22 are not parallel to the ground, containers may tend to slip out if the ribs 65 are omitted.

It will be appreciated that ribs may also be positioned circumferentially within the container accommodating interior walls. In such a structure, ribs will be positioned along the circumference of the container accommodating interior walls. Such a structure may be desirable in circumstances in which a user may not want the surface of the container to abut the interior surface of the container accommodating walls along the length of the opening. For example, a user having a rare, fine wine may want to avoid damaging or marring the wine label. In such circumstances, circumferential ribs in the container accommodating opening would prevent the label of the container from being marred or damaged.

In this alternative preferred embodiment, the rack element 10 is comprised of two element halves, a forward element half 10*a* and rear element half 10*b*. The forward and rear element halves 10*a* and 10*b* meet at seam 11. The forward and rear elements halves 10*a* and 10*b* are held together by glue or other attachment means well known to those having ordinary skill in the art.

Leveling ridges 13 are also provided where, because of the draft, the sidewall 16 is not perpendicular to the forward or rear walls, 14 and 17. The leveling ridges 13 increase in thickness as the distance from the seam increases. The increase in thickness of the leveling ridges is an amount to compensate for the sidewalls 16*a* and 16*b* not being perpendicular to the forward wall 14 and rear wall 17, respectively, thus maintaining the stability of the rack element 10 on the supporting surface (not shown).

Figure 12:
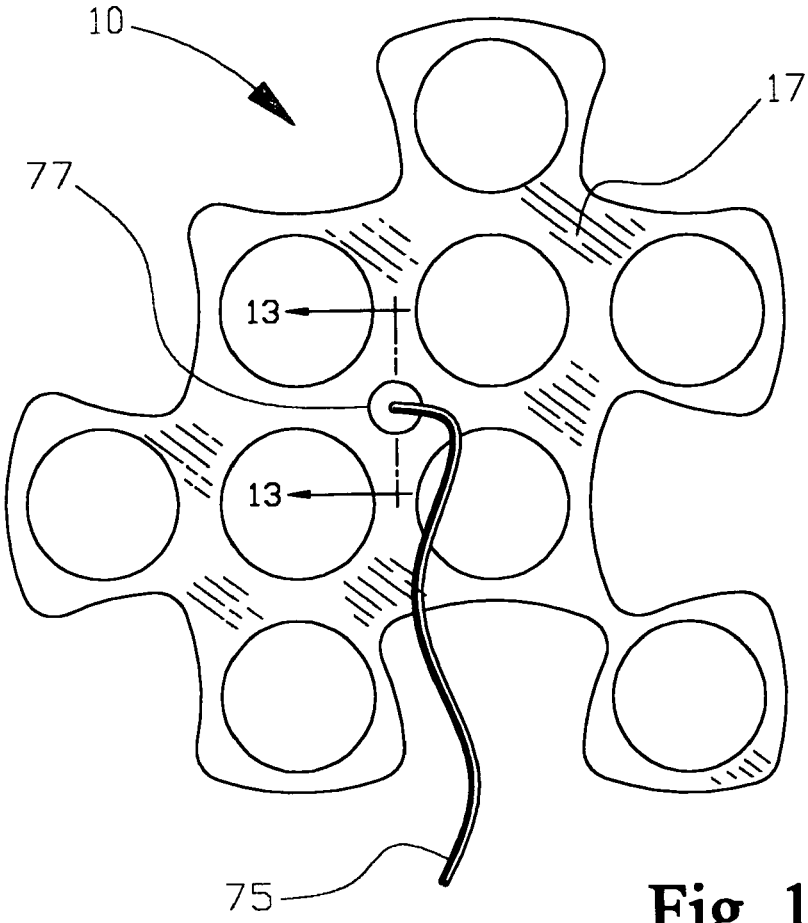
FIG. 12 is a rear elevational view of yet another embodiment of the invention.
Figure 13:
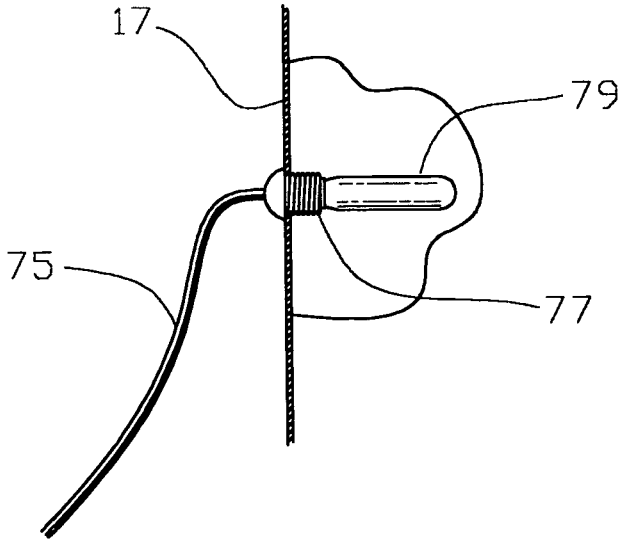
FIG. 13 is a cross-sectional view taken along line 13—13 of FIG. 12.
Figure 14:
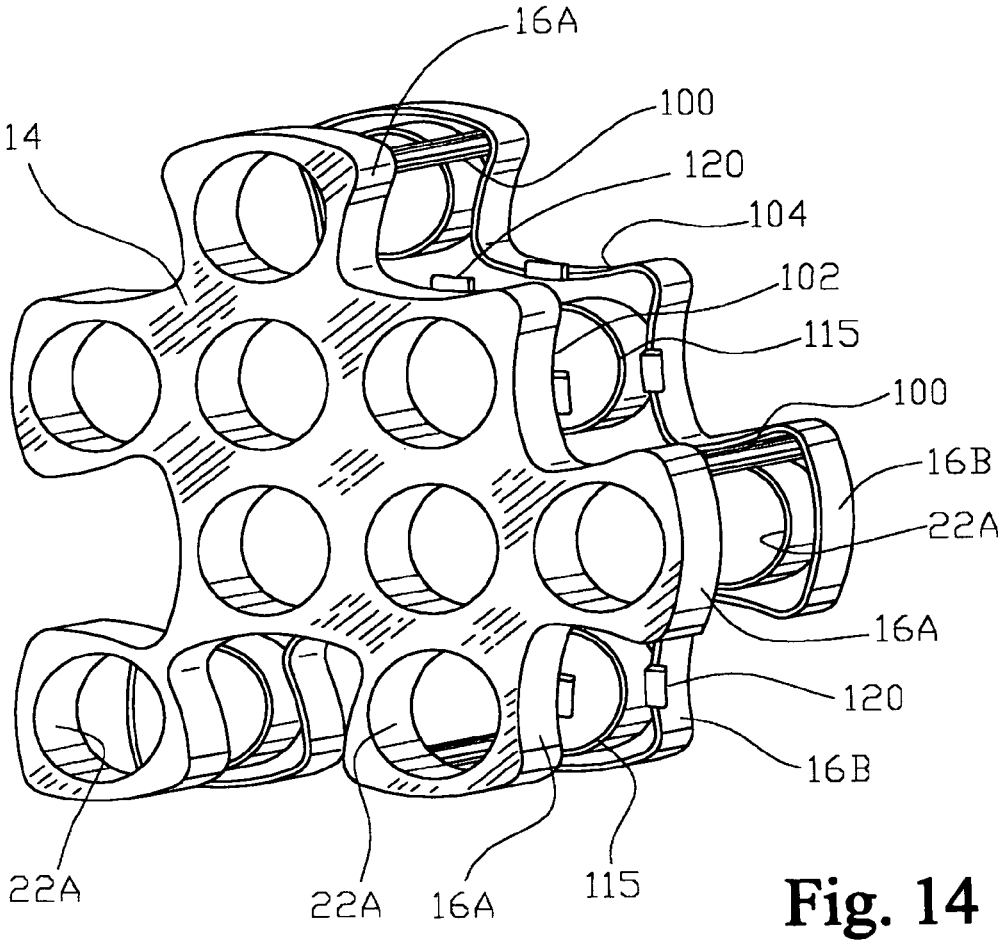
FIG. 14 is a perspective view of another embodiment of my invention.
Figure 15:
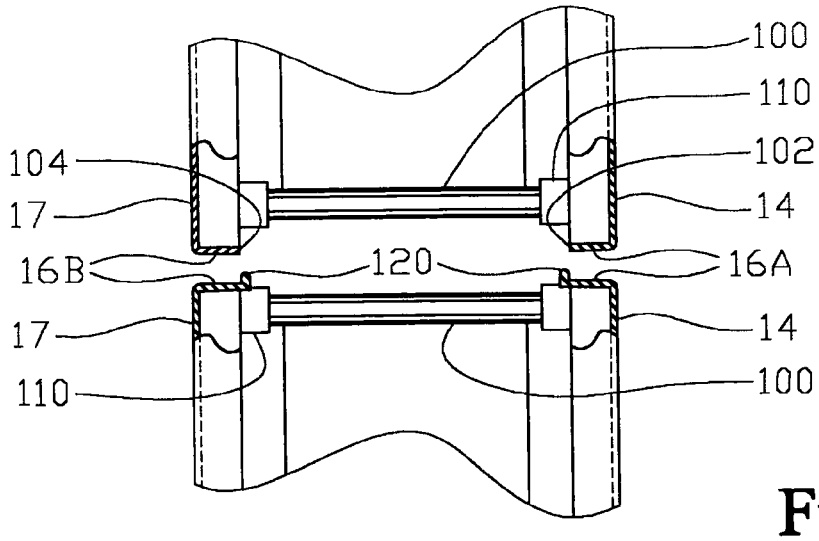
FIG. 15 is an enlarged view of the area of engagement of two elements of another embodiment of my invention.
Figure 16:
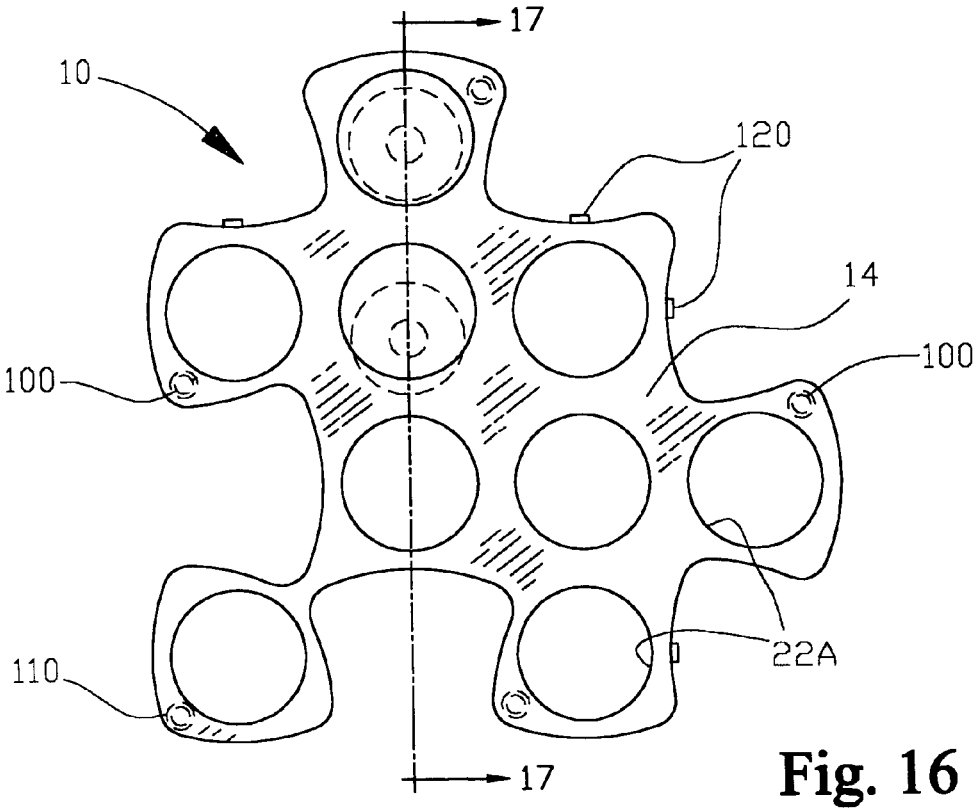
FIG. 16 is a front elevational view of another embodiment of my invention.
Figure 17:
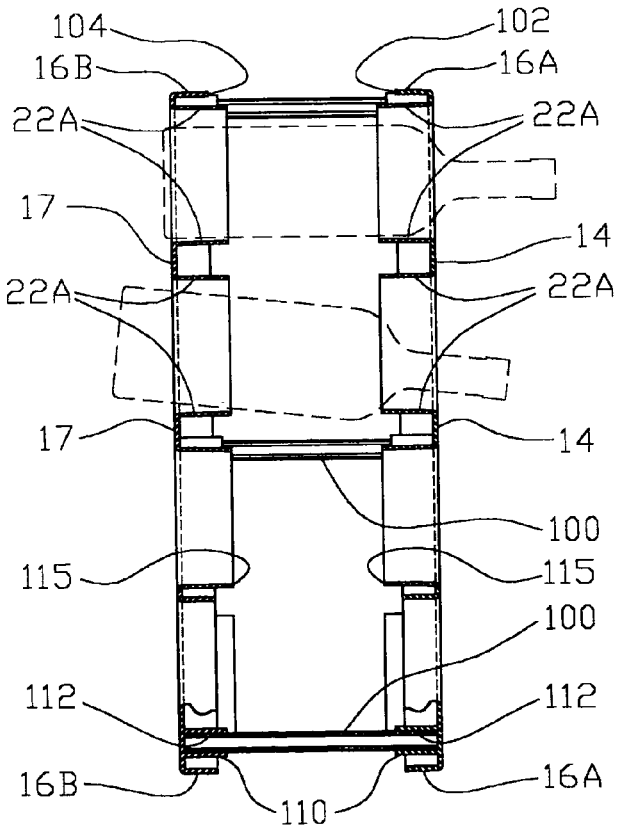
FIG. 17 is a cross-sectional view of another embodiment of my invention taken along line 17—17 of FIG. 16.

Referring now to FIGS. 12 and 13, there is disclosed another preferred embodiment of my invention. The rack element 10 is shown with an electrical light assembly affixed to the rear wall 17. The light sources comprise a two element electrical cord 75, a bulb socket 77, and a light source 79. In a preferred embodiment, the light source may comprise a light emitting diode or some other light source which does not generate heat. Such light sources may be of various glass and difference colors may be utilized in difference rack elements. In this embodiment, the rack element may be comprised of polypropylene or other transparent or semi-transparent material. In this configuration, the effect of the light of a single rack element and a plurality of each effect of the light of a single rack element and a plurality of each element is esthetically pleasing to the observer without degrading the advantages of the invention.

Next, referring to FIGS. 14, 15, 16 and 17, there is disclosed therein another preferred embodiment of my invention. In this embodiment, the rack element 10, is comprised of a forward wall 14, a partial forward side wall 16A, a rear wall 17, a partial rearward sidewall 16B and members 100. The forward sidewall 16A and rearward sidewall 16B have edges 102 and 104 respectively. As will be understood by those skilled in the art the edges 102 and 104 do not abut in this embodiment in my invention. On the inward surface of the forward wall 14 and inner surface of the rear wall 17 there are present member receiving fastening elements 110 with member receiving channels 112. The member receiving channels 112 are of a diameter sufficient to accept an end portion of a member 100, but sufficiently small to prevent the end portion of the member 110 from being easily moved within the member receiving channel 112.

Perpendicular to the forward wall 14 and rearward wall 17 there are located interior walls 22A. Each of the interior walls 22A has an edge 115. Each of the interior walls 22A in the forward wall 14 is located in corresponding relationship with a respective interior wall 22A in the rear wall 17. The interior walls 22A are of a depth relative to the forward and rear walls 14, 17 such that the edges 115 of corresponding interior walls 22A may or may not abut (in alternative embodiments).

The members 100 are of substantially equal length and the ends may be received within the member receiving channels 112 of the fastening elements 110. Each of the fastening elements 110 and member receiving channels 112 on the inner surface of the forward wall 14 and on the inner surface of rear wall 17, respectively, are in corresponding relationship. In this relationship, each end of the members 100 is mated with a fastening element 110 on the inner surface of the forward wall 14 and a corresponding fastening element 110 on the inner surface of the rear wall 17. Thus, the position of the forward and rear walls 14, 17 relative to each other is maintained and the unit has structural integrity.

At locations along the edges 102 and 104 there are located tabs 120. The tabs 120 project outwardly and perpendicularly to the sidewalls 16A and 16B. The tabs 120 are located such that the tabs 120 may engage the edges 102 and 104, respectively, of adjacent rack units. Thus, the rack units in this embodiment will be restrained from sliding forward or rearward relative to each other.

This embodiment has an open and spacious appearance and is more compatible with certain styles or modes of furniture and architecture.

Many modifications and other embodiments of the invention will come to mind to one who is skilled in the art to which this invention pertains having the benefit of the teachings presented in the above-description and the associated drawings. Therefore, it is to be understood that the invention is not to be limited to the specific embodiments disclosed and that modifications and other embodiments are intended to be included within the scope of the appended claims. Although specific terms are employed herein, they are used in a generic or descriptive sense only and not for the purpose of limitation.

What is claimed:

1. A modular rack comprising:

a plurality of rack elements, each rack element comprising a housing having a forward wall, a side wall and a rear wall, the side wall having at least one protrusion portion having a head portion and a neck portion, the head portion being larger than the neck portion, and at least one recession portion, the recession portion being of complementary shape to the protrusion portion, a plurality of forward container accommodating openings in the forward wall of each of the rack elements, each forward container accommodating opening defined by a forward interior container receiving wall and each of the rack elements having at least one forward container accommodating opening located in at least one protrusion portion of each rack element, wherein the protrusion portion of one rack element may be engaged with the recession portion of another rack element.

2. The modular rack of claim 1, wherein the protrusion portion of one rack element may be slideably interengaged with the recession portion of another rack element.

3. The modular rack of claim 2, wherein each of the rack elements is attached to at least one other rack element by having the protrusion portion of each of the rack elements slideably engaged with the recession portion of at least one other rack element.

4. The modular rack of claim 2, wherein at least one of the rack elements is solid.

5. The modular rack of claim 4, wherein at least one rack element is made of translucent material.

6. The modular rack of claim 5, including at least one electrically powered light located between the forward and rear walls of at least one rack element.

7. The modular rack of claim 2, wherein at least one of the rack elements is hollow.

8. The modular rack of claim 2, wherein the side wall has an outer surface and the slideable interengagement occurs in a direction parallel to the outer surface of the side wall defining the protrusion portion of the rack element.

9. The modular rack of claim 8, wherein at least one of the rack elements is solid.

10. The modular rack of claim 8, wherein at least one of the rack elements is hollow.

11. The modular rack of claim 8, wherein the slideable interengagement occurs in a direction parallel to the outer surface of the side wall defining the recession portion of the rack element.

12. The modular rack of claim 11, including a plurality of ribs extending laterally on the surface of each of the forward interior container receiving walls.

13. The modular rack of claim 12, wherein each of the forward container accommodating openings has a longitudinal axis and the longitudinal axis of each of the forward container accommodating openings is generally parallel.

14. The modular rack of claim 11, including a plurality of ribs extending circumferentially around the surface of each of the forward interior container receiving walls.

15. The modular rack of claim 11, wherein each of the forward interior container receiving walls extends from the forward wall to the rear wall of the rack elements.

16. The modular rack of claim 11, wherein the rear wall of each of the rack elements has a plurality of rear container accommodating openings in registry with the respective forward container accommodating openings, each rear container accommodating opening defined by a rear interior container receiving wall and wherein at least one forward interior container receiving wall does not extend to its corresponding rear container receiving wall.

17. The modular rack of claim 16, including at least one tab located proximate the edge of the side wall of each of the rack elements for limiting movement of adjacent rack elements.

18. The modular rack of claim 16 wherein the forward wall has an inner surface and the rear wall has an inner surface.

19. The modular rack of claim 18 including a plurality of spacing members, each spacing member having a forward end and a rearward end, a plurality of fastening elements located on the inner surfaces of the forward and rear walls, the fastening elements located on the inner surface of the forward wall positioned to be in registry with the fastening elements located on the inner surface of the rear wall, wherein the forward end of the spacing members are adapted to engage the fastening elements on the inner surface of the forward wall, and the rearward ends of the spacing members are adapted to engage the fastening members on the inner surface of the rear wall.

20. The modular rack of claim 19, wherein the spacing members are of substantially equal length.

21. The modular rack of claim 16, including at least one tab member on the side wall of each of the rack elements for limiting movement of adjacent rack elements.

22. The modular rack of claim 11, wherein at least one of the rack elements is solid.

23. The modular rack of claim 11, wherein at least one of the rack elements is hollow.

24. The modular rack of claim 1, wherein at least one wall of the rack element is made of a translucent material.

25. The modular rack of claim 24, including at least one electrically powered light located between the forward and rear walls of at least one rack element.

26. The modular rack of claim 1, wherein at least one of the rack elements is solid.

27. The modular rack of claim 1, wherein at least one wall of a rack element is made of transparent material.

28. The modular rack of claim 1, wherein at least one of the rack elements is hollow.

29. The modular rack of claim 28, wherein at least one wall of a rack element is made of transparent material.

30. The modular rack of claim 29, including at least one electrically powered light located between the forward and rear walls of at least one rack element.

31. A rack for storing containers comprising:

a plurality of housings, each housing having a forward wall, a rear wall and an edge wall;

a plurality of recesses in the forward wall of each of the housings, each recess adapted to receive a container;

at least one protrusion portion formed by the side wall and the forward and rear walls of each of the housings, the protrusion portion having a head portion and a longitudinal axis and adapted to be joined to a recess of a corresponding housing by a neck portion, the neck portion being smaller than the head portion to prevent longitudinal motion of adjacent housings when the protrusion portion of a housing is engaged with the recess of the adjacent housing;

at least one recession portion in the housing formed by the side wall and the forward and rear walls of the housing, the shape of the recession portion corresponding to the size and shape of the protrusion portion, wherein at least one of the plurality of recesses is positioned in at least one protrusion portion of each housing.

* * * * *